US009397440B2

(12) United States Patent
Mori et al.

(10) Patent No.: US 9,397,440 B2
(45) Date of Patent: Jul. 19, 2016

(54) CONNECTOR

(71) Applicant: Yazaki Corporation, Tokyo (JP)

(72) Inventors: Shigeo Mori, Kakegawa (JP); Masayuki Kataoka, Kakegawa (JP); Fuminori Sugiyama, Kakegawa (JP); Yoshitaka Koda, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/593,030

(22) Filed: Jan. 9, 2015

(65) Prior Publication Data

US 2015/0118905 A1 Apr. 30, 2015

Related U.S. Application Data

(63) Continuation of application No. PCT/JP2013/069024, filed on Jul. 11, 2013.

(30) Foreign Application Priority Data

Jul. 11, 2012 (JP) ..... 2012-155557

(51) Int. Cl.
*H01R 13/58* (2006.01)
*H01R 13/504* (2006.01)
(Continued)

(52) U.S. Cl.
CPC ..... *H01R 13/5845* (2013.01); *H01R 13/405* (2013.01); *H01R 13/504* (2013.01); *H01R 13/52* (2013.01); *H01R 13/5205* (2013.01)

(58) Field of Classification Search
CPC ..... H01R 13/405; H01R 13/521; H01R 13/5845; H01R 13/5205; H01R 13/5216; H01R 43/24
USPC ..... 439/604, 606, 736, 936
See application file for complete search history.

(56) References Cited

U.S. PATENT DOCUMENTS 5,567,170 A * 10/1996 Kroeber ..... H01R 13/533 439/186
6,102,739 A * 8/2000 Murakami ..... F16H 61/0006 439/587

(Continued)

FOREIGN PATENT DOCUMENTS

JP 58-131576 U 9/1983
JP 10-012319 A 1/1998

(Continued)

OTHER PUBLICATIONS

International Preliminary Report on Patentability for PCT/JP2013/069024 dated Jan. 13, 2015 [PCT/IB/373].

(Continued)

*Primary Examiner* — Hien Vu
(74) *Attorney, Agent, or Firm* — Sughrue Mion, PLLC

(57) ABSTRACT

A connector includes: a terminal which is fixed to a conductor exposed from an end portion of a covered wire; a sealing portion which is made of an insulating and elastic material, and which integrally covers an adjacent portion of the terminal and a sheath of the covered wire; and a housing which is made of an insulating resin having rigidity higher than the elastic material, and which integrally covers whole of the sealing portion provided around the end portion of the covered wire. A terminal-side end face of the sealing portion is exposed from the housing at a bottom of an annular recess formed in a terminal-side end face of the housing so as to surround the terminal.

4 Claims, 8 Drawing Sheets

(51) Int. Cl.
*H01R 13/52* (2006.01)
*H01R 13/405* (2006.01)

(56) References Cited

U.S. PATENT DOCUMENTS

| | | | | |
|---|---|---|---|---|
| 6,619,996 | B2 * | 9/2003 | Hara | H01R 13/5221 439/275 |
| 6,932,657 | B2 * | 8/2005 | Mizutani | B29C 45/14311 439/736 |
| 8,480,421 | B2 * | 7/2013 | Yoshioka | H01R 43/24 439/275 |
| 2012/0040571 | A1 | 2/2012 | Yoshioka et al. | |

FOREIGN PATENT DOCUMENTS

| | | | |
|---|---|---|---|
| JP | 2001-023720 | A | 1/2001 |
| JP | 2001-273946 | A | 10/2001 |
| JP | 2002-024468 | A | 1/2002 |
| JP | 2002-208456 | A | 7/2002 |
| JP | 2002-254468 | A | 9/2002 |
| JP | 2003-272729 | A | 9/2003 |
| JP | 2008-269858 | A | 11/2008 |
| JP | 2011-014260 | A | 1/2011 |
| JP | 4651961 | B2 | 3/2011 |

OTHER PUBLICATIONS

Written Opinion for PCT/JP2013/069024 dated Aug. 20, 2013, [PCT/ISA/237].

Search Report dated Aug. 20, 2013, issued by the International Searching Authority in counterpart International Application No. PCT/JP2013/069024.

Written Opinion dated Aug. 20, 2013, issued by the International Searching Authority in counterpart International Application No. PCT/JP2013/069024.

Communication from the Japanese Patent Office dated Nov. 24, 2015 in a counterpart Japanese application No. 2012-155557.

* cited by examiner

CONNECTOR

CROSS REFERENCE TO RELATED APPLICATION(S)

This application is a continuation of PCT application No. PCT/JP2013/069024, which was filed on Jul. 11, 2013 based on Japanese Patent Application (No. 2012-155557) filed on Jul. 11, 2012, the contents of which are incorporated herein by reference.

BACKGROUND OF THE INVENTION

1. Field of the Invention

The present invention relates to a connector.

2. Description of the Related Art

Connectors are known in which electric wires are covered with a soft resin member which is covered with a housing made of a hard resin material (refer to JP-A-2001-273946).

In a shield wire 501 shown in FIG. 7, a shield wire 503 is covered with a cylindrical housing 505 and a terminal metal fitting 511 is fixed to a portion, exposed from a core 507 of the shield wire 503, of a conductor 509. The gap between a sheath 513 of the shield wire 503 and the housing 505 is sealed by a heat insulation layer 515 made of urethane which is relatively soft. In a state that the shield wire 501 is attached to a shield wall 517, the gap between an attachment hole 519 and the housing 505 that penetrates through the attachment hole 519 is sealed by an O-ring 521 and the shield wall 517 and a shield layer 523 of the shield wire 503 are electrically connected to each other. Since the housing 505 covers the exposed portion of the conductor 509 in a liquid-tight manner, there is no probability that liquid goes into the inside of the shield wire 503 passing through the gaps between the element wires of the conductor 509.

In a connector 525 shown in FIG. 8 which is disclosed in JP-A-2008-269858, a terminal 527 and a sheath 529 are together covered with a primary resin mold member 531. A first sealing member 535 for sealing a first joining portion 533 of the primary resin mold member 531 and the sheath 529 is disposed there. The first sealing member 535 and the primary resin mold member 531 are together covered with a secondary resin mold member 537. The secondary resin mold member 537 suppresses pealing of the first sealing member 535 from the first joining portion 533, whereby the durability of the waterproof structure is increased.

SUMMARY OF THE INVENTION

However, in the above-described shield connector 501, the housing 505 is in close contact with the outer circumferential surface of a front half portion of a hot melt adhesive 541 coating region of a base portion of a tab 539 of the terminal metal fitting 511. In the above-described connector 525, the terminal 527 and the sheath 529 are together covered with the primary resin mold member 531 and the first sealing member 535 is covered with the primary resin mold member 531 and the secondary resin mold member 537 combined. Therefore, since the terminal metal fitting 511 or the terminal 527 (they are metal components) is covered with the housing 505 or the secondary resin mold member 537 (they are made of a hard resin material), a crack may develop in the housing 505 or the secondary resin mold member 537 in the terminal insertion portion due to expansion or contraction at the occurrence of thermal stress or position adjustment (displacement) at the time of attachment of the terminal.

The present invention has been made in view of the above circumstances, and an object of the present invention is therefore to provide a connector capable of preventing a terminal insertion portion of a housing from being damaged by displacement of a terminal.

The above object of the invention is attained by the following configurations:

(1) A connector including: a terminal which is fixed to a conductor exposed from an end portion of a covered wire; a sealing portion which is made of an insulating and elastic material, and which integrally covers an adjacent portion of the terminal and a sheath of the covered wire; and a housing which is made of an insulating resin having rigidity higher than the elastic material, and which integrally covers whole of the sealing portion provided around the end portion of the covered wire, wherein a terminal-side end face of the sealing portion is exposed from the housing so as to surround the terminal.

In the connector having the configuration of item (1), since the housing covers the sealing portion in such a manner that the terminal-side end face of the sealing portion is exposed so as to surround the terminal, a portion of the sealing portion is interposed between the terminal and the housing and hence the housing made of the insulating resin does not cover the terminal directly. As a result, the sealing portion which is made of the elastic material can absorb displacement, expansion, or contraction of the terminal, whereby damaging of the terminal insertion portion of the housing can be suppressed.

(2) The connector having the configuration of item (1), wherein the terminal-side end face of the sealing portion is exposed from the housing through an annular recess formed in the housing so as to surround the terminal.

In the connector having the configuration of item (2), the terminal-side end face of the sealing portion is located in the annular recess of the housing. As a result, there does not occur an event that when deformed by movement, expansion, or contraction of the terminal a portion, including the terminal-side end face, of the seal portion swells out of a terminal-side end face of the housing and impairs connector fitting.

The invention has been described above concisely. The details of the invention will become more apparent when the section "modes for carrying out the invention" (hereinafter referred to as an embodiment) described below is read through with reference to the accompanying drawings.

DETAILED DESCRIPTION OF THE EXEMPLARY EMBODIMENTS

Figure 1:
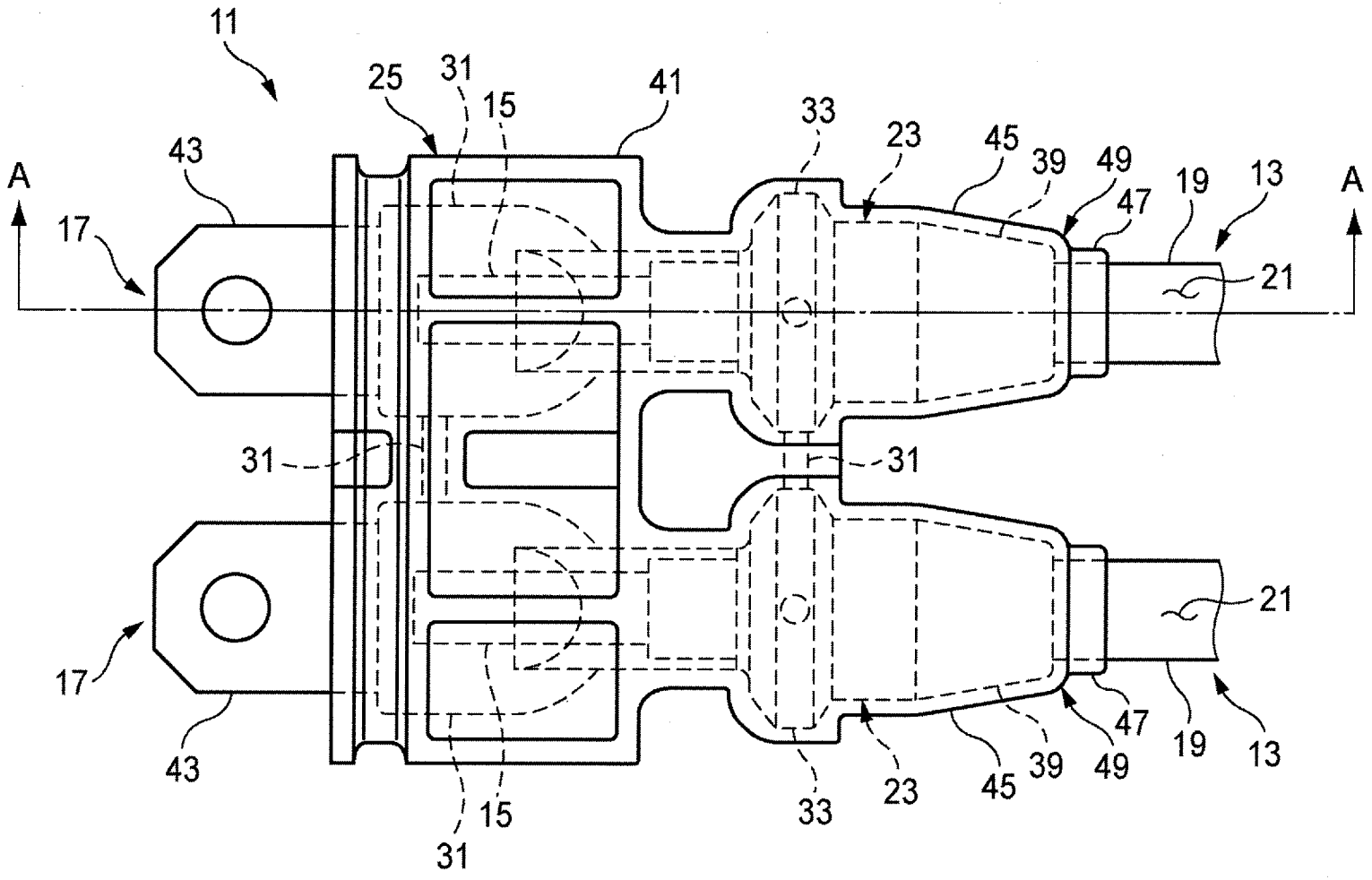
FIG. 1 is a plan view of a connector according to an embodiment of the present invention.
Figure 2:
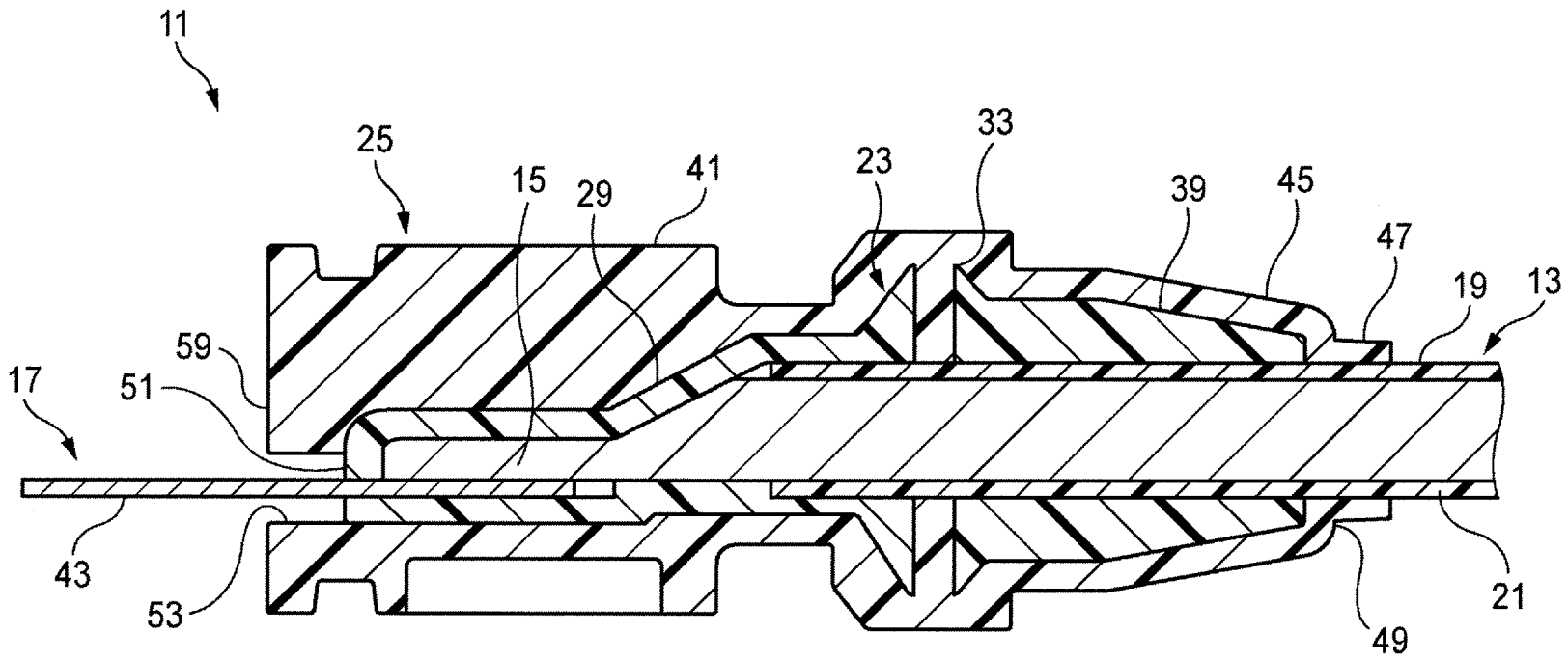
FIG. 2 is a sectional view, taken along arrow A-A, of the connector shown in FIG. 1.

An embodiment of the present invention will be hereinafter described with reference to the drawings.

As shown in FIGS. 1-4, a connector 11 according to the embodiment is so called an overmolded connector in which a terminal 17 is connected to a conductor 15 of each covered wire 13, and the connection portion, that is, an end portion 19 of the covered wire 13 and a part of the terminal 17, is covered with resin molds. In this specification, the connector 11 will be described with its terminal side and covered wire side referred to as the front side and the read side, respectively.

The covered wire 13 having the conductor 15 covered with a sheath 21 is connected to the connector 11 according to the embodiment. The covered wire used in the invention may be either a covered wire 13 having the conductor 15 covered with only a sheath 21 or a shield wire in which the outer surface of an internal insulating sheath covering a conductor is covered with a metal braid and the outer surface of the metal braid is covered with an outer sheath. The connector 11 according to the embodiment is provided for a plurality of (in the embodiment, two) covered wires 13 having conductors 15 connected to respective terminals 17 which are arranged side by side.

The terminal 17 is connected and fixed to the conductor 15 exposed from the end portion 19 of the corresponding covered wire 13. A connection structure of the terminal 17 and the conductor 15 may be any of a crimping structure, a pressure contact structure, a welding structure, a brazing structure, etc. Although in the embodiment a flat terminal which is a male terminal is employed as an example of the terminal 17, the terminal 17 may be a ring terminal, a Y-shaped terminal, a female terminal having a box-shaped electrical contact portion, or the like.

The connector 11 is produced in such a manner that conductors 15 and end portions 19 of covered wires 13 are subjected to primary molding using an insulating and elastic material such as a thermoplastic elastomer to form sealing portions 23 (see FIG. 4) and then the sealing portions 23 and the end portions 19 are subjected to secondary molding using an insulating resin such as a thermoplastic resin to form a housing 25 (see FIG. 1).

The sealing portions 23 are made of a thermoplastic elastomer and are linked to each other by link portions 31. Each of the sealing portions 23 covers a joining portion 29 of each of the two terminals 17 separated from each other and arranged side by side and the sheath 21 of a corresponding one of the two covered wires 13 separated from each other and arranged side by side. A material capable of easily bonding to the sheaths 21 of the covered wires 13, the terminals 17, and the housing 25 is selected as the thermoplastic elastomer.

Thermoplastic elastomers can be modified so as to be able to be thermally bonded to thermoplastic resins having high polarity value (solubility parameter) such as an ordinary ABS resin and polycarbonate, glass, various metals, light metals such as aluminum and magnesium alloys and to be superior in flexibility and moldability.

Figure 4:
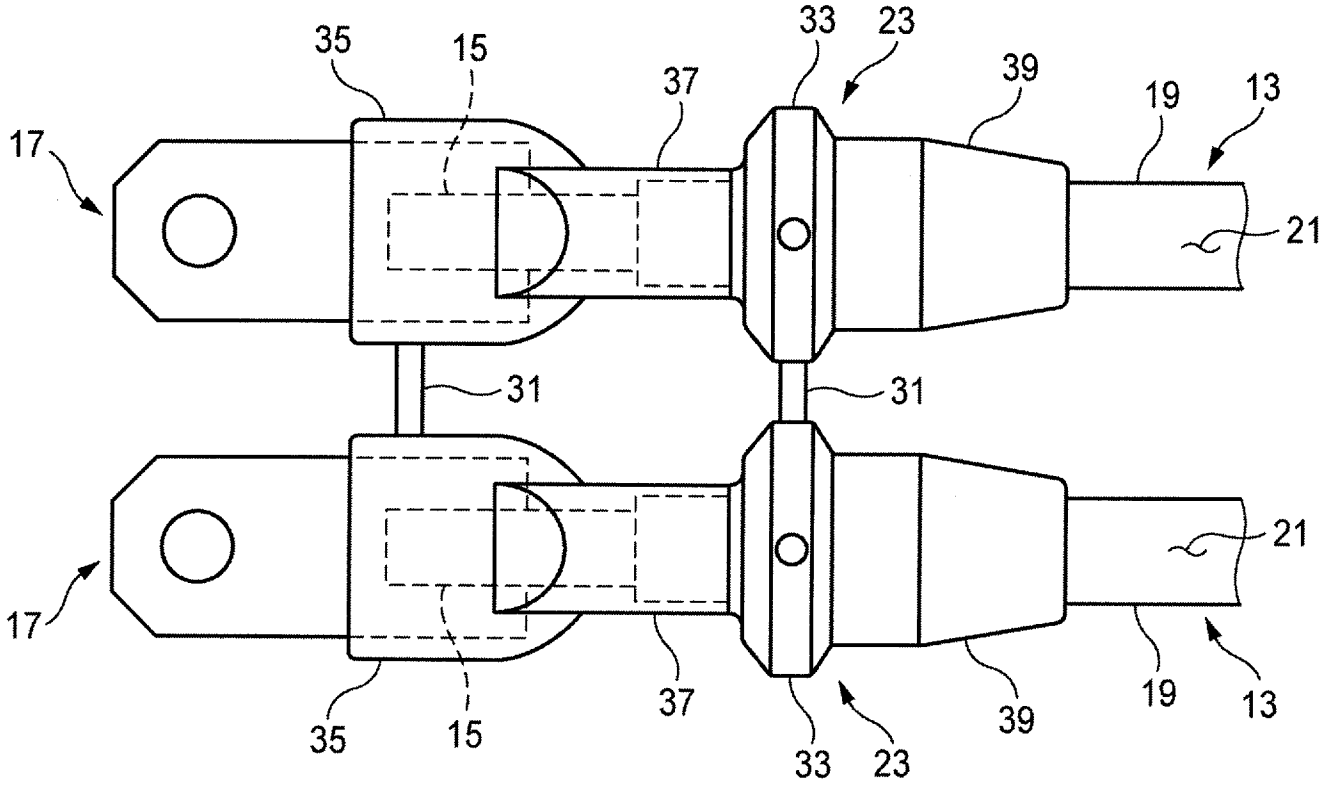
FIG. 4 is a plan view of the connector shown in FIG. 1 with a housing omitted.

As shown in FIG. 4, the plurality of (in the embodiment, two) link portions 31 are arranged in the longitudinal direction of the covered wires 13. In the embodiment, the sealing portion 23 is formed with a flange 33 on the covered wire side and with a terminal mold portion 35 on the terminal side. The sealing portion 23 is formed, between the terminal mold portion 35 and the flange 33, with a constricted portion 37 which is smaller in diameter than the terminal mold portion 35 and the flange 33. Each sealing portion 23 is further formed, on the covered wire side of the flange 33, with a waterproof cylinder 39 which covers an outer circumferential surface of the covered wire 13. The adjoining flanges 33 and the adjoining terminal mold portions 35 of the sealing portions 23 are linked to each other by the respective link portions 31.

The housing 25 is made of an insulating resin which has rigidity higher than the elastic material of the sealing portions 23 and integrally covers whole of the sealing portions 23 provided around the end portion 19 of the corresponding covered wire 13. That is, the housing 25 covers all of the terminal mold portions 35, the flanges 33, and the waterproof cylinders 39 of the two sealing portions 23 which are arranged side by side. The housing 25 is a housing body 41 which is approximately uniform in thickness, conforms to the outlines of the terminal mold portions 35, the flanges 33, and the waterproof cylinders 39, and is shaped like solid blocks between the terminal mold portions 35 and the flanges 33 (see FIG. 1). Thus, the housing body 41 is shaped in such a manner that electrical contact portions 43 of the terminals 17 project forward and the pair of waterproof cylinders 39 which are covered with the housing 25 extend rearward. As shown in FIG. 4, the covered wires 13 lead rearward out of the respective waterproof cylinders 39. Since the waterproof cylinders 39 are covered with the housing 25, the covered wires 13 directly lead out of respective waterproof cylinder sheaths 45 of the housing 25.

Each waterproof cylinder sheath 45 is formed with a small diameter portion 47 at its rear end, whereby a step portion 49 is formed. The small diameter portion 47 which covers an outer circumferential surface of the covered wire 13 is thin. In the connector 11 according to the embodiment, because of the presence of the thin small diameter portion 47, stronger adhesion is secured between each waterproof cylinder sheath 45 and the covered wire 13 than in a case that the covered wire 13 leads directly from the waterproof cylinder sheath 45 not having the small diameter portion 47. The small diameter portion 47 is made of the thermoplastic resin that is higher in rigidity than the thermoplastic elastomer. However, being thin, the small diameter portion 47 can follow a wire bend to some extent, that is, in such a range that peeling does not occur at the boundary between the waterproof cylinder 39 and the covered wire 13. That is, the small diameter portion 47 suppresses peeling at the boundary between the waterproof cylinder 39 and the covered wire 13 while allowing the covered wire 13 to bend together in such a range.

Figure 3:
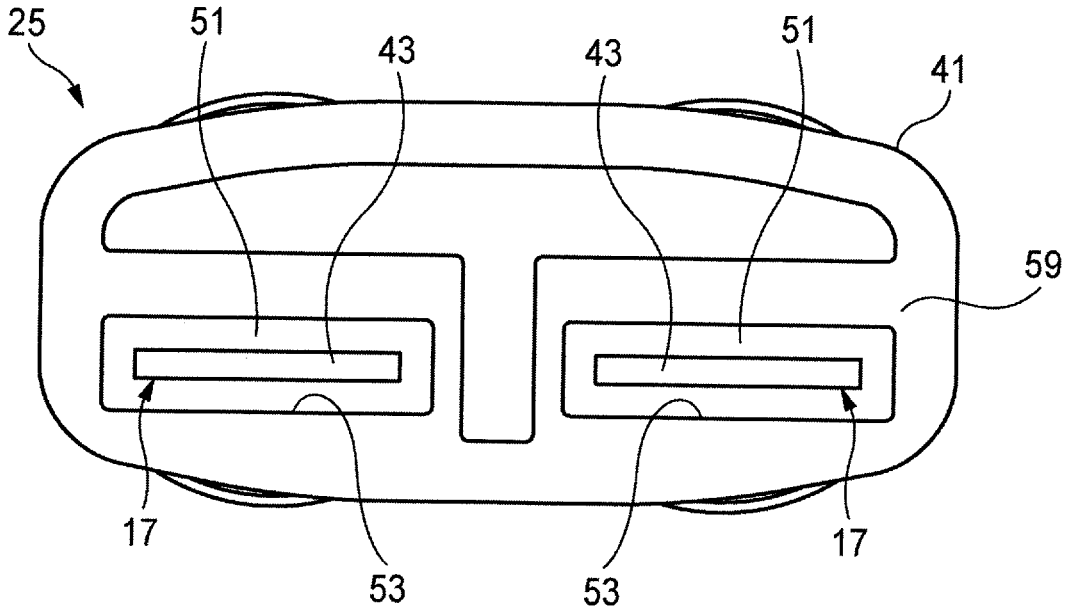
FIG. 3 is a front view of the connector shown in FIG. 1.

Furthermore, in the connector 11 according to the embodiment, terminal-side end faces 51 of the sealing portions 23 are exposed from the housing 25 so as to surround the terminals 17, respectively (see FIG. 3). The terminal-side end face 51 is exposed from a terminal-side end face 59 of the housing 25 by an annular recess 53 which is formed in the housing 25 so as to surround the terminal 17. That is, the terminal-side end face 51 of each sealing portion 23 which covers the terminal 17 exposed at a bottom of the annular recess 53 (see FIG. 2). As such, the terminal-side end face 51 of each sealing portion 23 is exposed to the outside through the annular recess 53. Each annular recess 53 serves as a cavity for preventing an event that a portion of the sealing portion 23 that is deformed by displacement of the terminal 17 swells out of the terminal-side end face 59 of the housing 25.

The above-described connector 11 is manufactured in the following manner. First, covered wires 13 in which terminals 17 are fixed to conductors 15 are set in a primary molding die (not shown) and sealing portions 23 shown in FIG. 4 are formed by primary molding.

Figure 5:
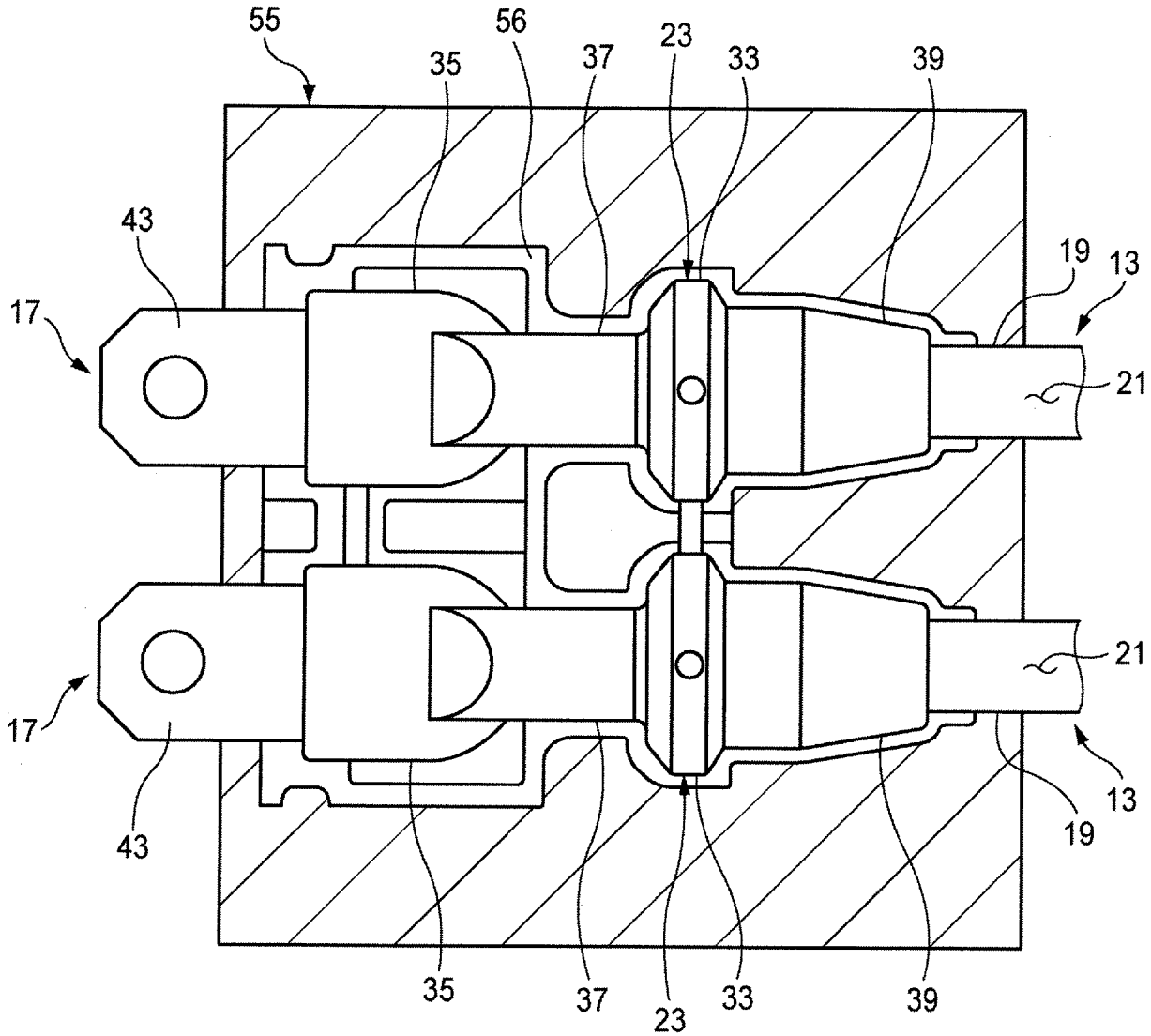
FIG. 5 is a horizontal sectional view of an injection molding die for molding of the housing shown in FIG. 1.
Figure 6:
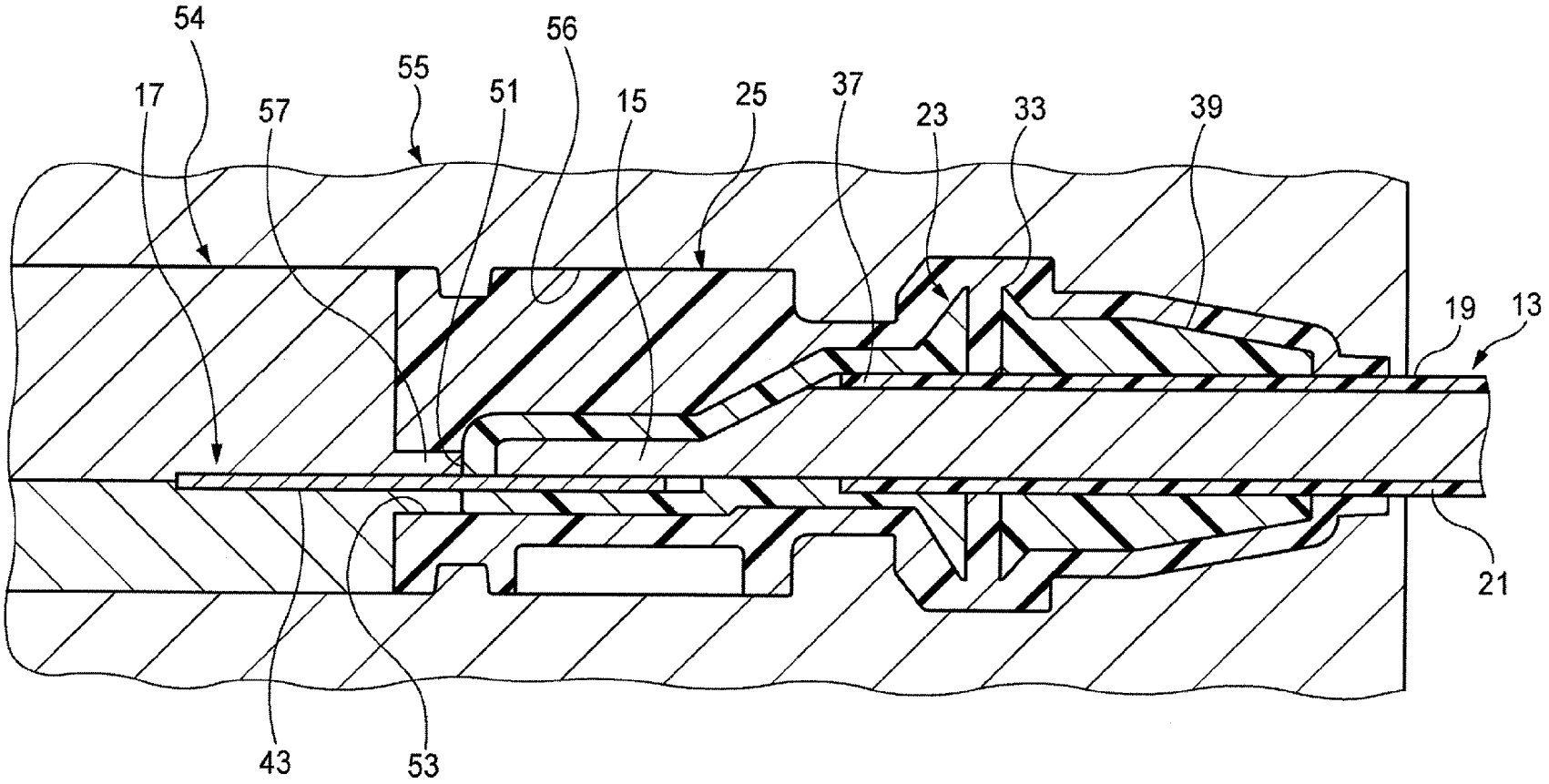
FIG. 6 is a vertical sectional view of the injection molding die for molding of the housing shown in FIG. 1.
Figure 7:
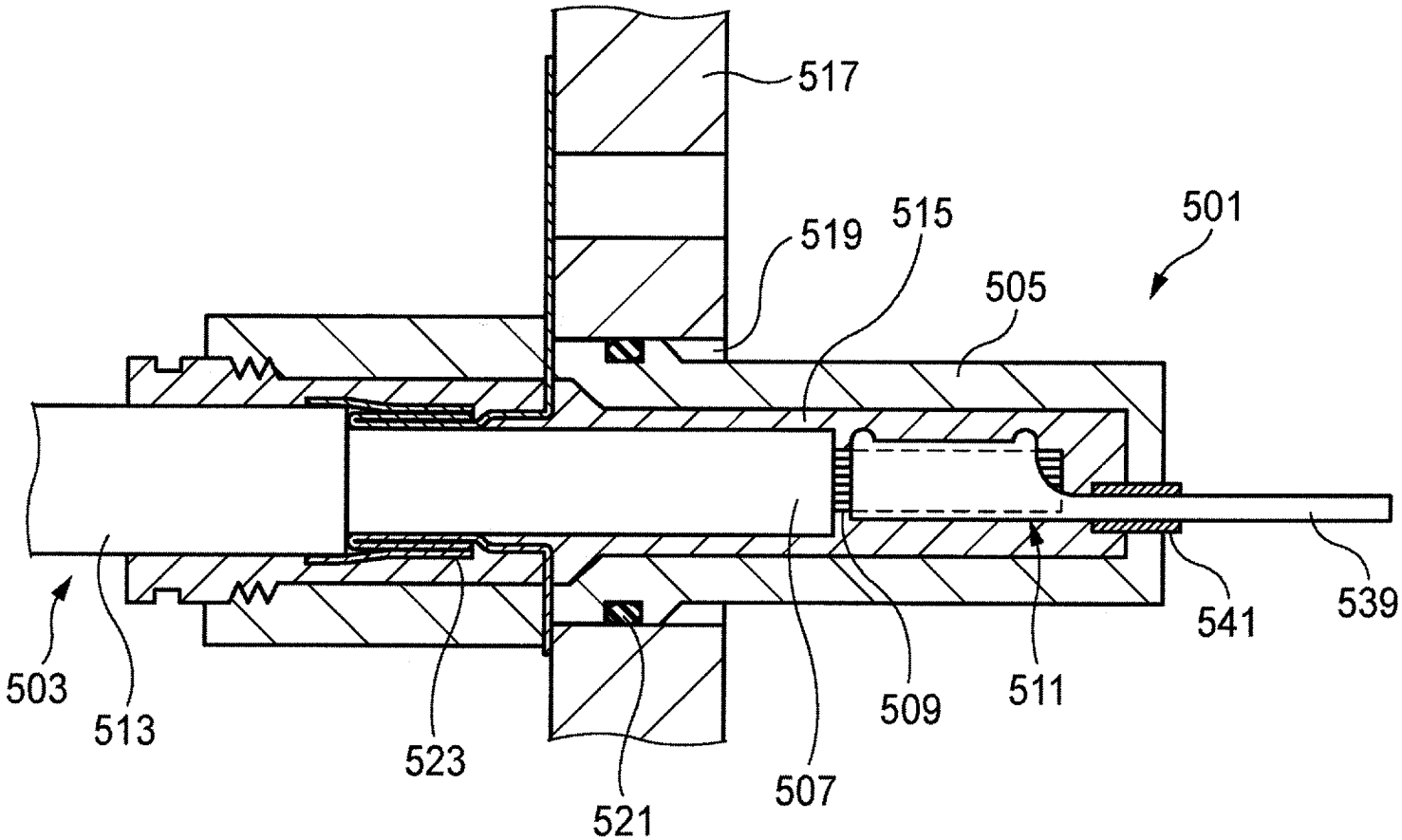
FIG. 7 is a vertical sectional view of a conventional shield connector.
Figure 8:
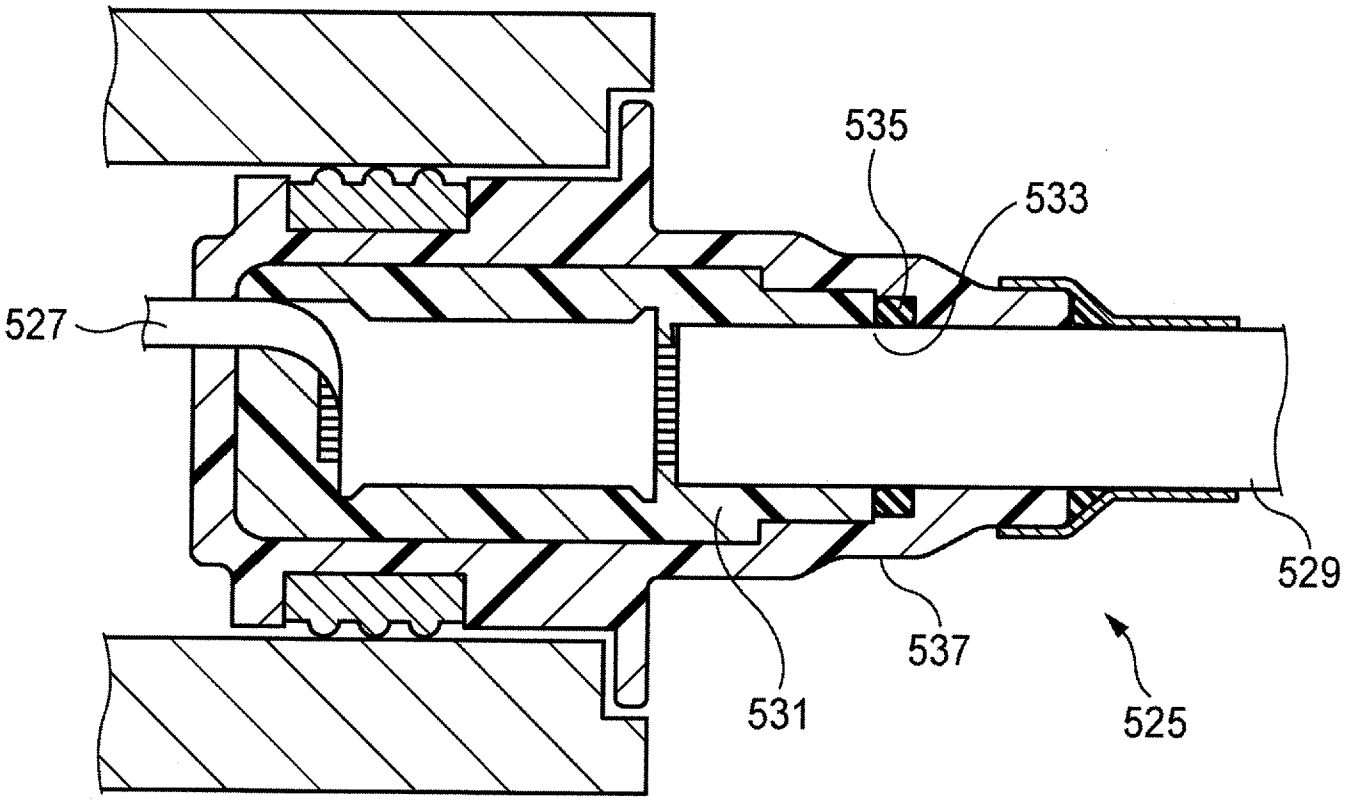
FIG. 8 is a vertical sectional view of a conventional connector.

After the formation of the sealing portions 23 by the primary molding, the covered wires 13 with the sealing portions 23 are inserted into a cavity 56 of a secondary molding die (injection molding die) 55 shown in FIGS. 5 and 6 and secondary molding is performed using an insulating resin, whereby a housing 23 shown in FIG. 1 is molded. That is, the sealing portions 23 are formed using a thermoplastic elastomer which is an elastic material and the housing 25 is formed using a thermoplastic resin which is an insulating resin. The secondary molding die 55 is equipped with a slide core 54 which has annular projections 57 for molding of the annular recesses 53 of the housing 25. The slide core 54 having the annular projections 57 may be incorporated in the secondary molding die 55 so as to be slidable and dividable.

The end portions 19 of the two covered wires 13 to which the respective terminals 17 are fixed can be positioned with respect to each other by the pair of sealing portions 23 which are linked to each other by the link portions 31. Since the sealing portions 23 that have been attached to the respective end portions 19 of the two covered wires 13 by the primary molding are then covered with the housing 25, the end portions 19 of the covered wires 13 to which the respective terminals 17 are fixed can be positioned accurately in the cavity 56 of the secondary molding die 55 when the secondary molding is performed using the insulating resin. As a result, the efficiency of molding work in which the end portions 19 of the covered wires 13 are set in the cavity 56 is increased. Furthermore, there does not occur an event that the end portions 19 of the covered wires 13 that are inserted in the cavity 56 are deviated by injection pressure that acts on the secondary molding resin (insulating resin) to render the thickness of the housing 25 not uniform. Thus, a connector 11 having accurate dimensions can be produced.

Next, a description will be made of workings of the connector 11 having the above configuration.

In the above-described connector 11, whereas the terminal-side end faces 51 of the sealing portions 23 are exposed from the terminal-side end face 59 of the housing 25, the outer circumferential surfaces of sealing portions 23 around the center axis of the covered wire 13 are completely covered with the housing 25. Therefore, the housing 25 prevents each sealing portion 23 from being deformed following a bend of the covered wire 13. As a result, stress produced by the wire bend is not transmitted to the boundary between the sheath 21 and the sealing portion 23 and peeling at the boundary can be suppressed.

Since the housing covers the sealing portions 23 so that the terminal-side end face 51 of each sealing portion 23 is exposed so as to surround the terminal 17, the terminal 17 is not directly covered with the housing 25 which is made of the insulating resin; instead, a portion of the sealing portion 23 is interposed between the terminal 17 and the housing 25. Therefore, the sealing portion 23 which is made of the elastic material can absorb displacement, expansion, or contraction of the terminal 17, whereby damaging of the terminal insertion portion of the housing 25 can be suppressed.

Furthermore, the terminal-side end face 51 of each sealing portion 23 is exposed from the housing 25 through the annular recess 53 which is formed in the housing 25 so as to surround the terminal 17. That is, the terminal-side end face 51 of the sealing portion 23 exists in the annular recess 53 of the housing 25. Therefore, there does not occur an event that when deformed by movement, expansion, or contraction of the terminal 17 a portion, including the terminal-side end face 51, of the sealing portion 23 swells out of the terminal-side end face 59 (see FIG. 2) of the housing 25 and impairs connector fitting.

Still further, each sealing portion 23 made of the thermoplastic elastomer is bonded to the sheath 21 of the covered wire 13 and the terminal 17 by the primary molding, whereby sealing is secured there. Therefore, it is not necessary to dispose a separate sealing member between the housing 25 and the sheath 21 or between the housing 25 and the terminal 17.

As such, the connector 11 according to the embodiment can prevent destruction of the corresponding terminal insertion portion of the housing 25 due to displacement of a terminal 17.

The features of the above-described connector according to the embodiment of the invention will be summarized below concisely:

[1] A connector 11 including: a terminal 17 which is fixed to a conductor 15 exposed from an end portion 19 of a covered wire 13; a sealing portion 23 which is made of an insulating and elastic material, and which integrally covers an adjacent portion of the terminal 17 and a sheath 21 of the covered wire 13; and a housing 25 which is made of an insulating resin having rigidity higher than the elastic material, and which integrally covers whole of the sealing portion 23 provided around the end portion 19 of the covered wire 13, wherein a terminal-side end face 51 of the sealing portion 23 is exposed from the housing 25 so as to surround the terminal 17.

[2] The connector 11 having the configuration of item [1], wherein the terminal-side end face 51 of the sealing portion 23 is exposed from the housing 25 through an annular recess 53 formed in the housing 25 so as to surround the terminal 17.

The connector according to the invention is not limited the above-described one according to the above embodiment, and various modifications, improvements, etc. can be made as appropriate. And the material, shape, dimensions, number, location, etc. of each constituent element of the above embodiment are optional and no limitations are imposed on them as long as the invention can be implemented.

The connector according to the invention can prevent a terminal insertion portion of a housing from being damaged by displacement of a terminal.

What is claimed is:

1. A connector comprising:

a terminal which is fixed to a conductor exposed from an end portion of a covered wire;

a sealing portion which is made of an insulating and elastic material, and which integrally covers an adjacent portion of the terminal and a sheath of the covered wire; and a housing which is made of an insulating resin having rigidity higher than the elastic material, and which integrally covers an entirety of the sealing portion provided around the end portion of the covered wire, wherein a terminal-side end face of the sealing portion is exposed from the housing at a bottom of an annular recess formed in a terminal-side end face of the housing, the terminal-side end face surrounding the terminal; and wherein the terminal-side end face of the sealing portion is located in the annular recess so as to define an entirety of the bottom of the annular recess.

2. The connector according to claim 1, wherein the housing contacts the sheath of the covered wire.

3. The connector according to claim 1, wherein the housing covers and contacts at least a portion of the terminal-side end face of the sealing portion.

4. The connector according to claim 1, wherein a tip end of the terminal protrudes from the terminal-side end face of the housing through the annular recess from the terminal-side end face of the sealing portion.

* * * * *